US007556678B2

(12) United States Patent
Hayakawa et al.

(10) Patent No.: US 7,556,678 B2
(45) Date of Patent: Jul. 7, 2009

(54) GAS GENERATOR

(75) Inventors: Hiroshi Hayakawa, Nishiyodogawa-ku (JP); Osamu Yoshimoto, Nishiyodogawa-ku (JP); Noriyuki Tanaka, Nishiyodogawa-ku (JP); Jiro Hiraiwa, Nishiyodogawa-ku (JP); Tetsuro Tojo, Nishiyodogawa-ku (JP)

(73) Assignee: Toyo Tanso Co., Ltd., Osaka (JP)

( * ) Notice: Subject to any disclaimer, the term of this patent is extended or adjusted under 35 U.S.C. 154(b) by 284 days.

(21) Appl. No.: 11/003,867

(22) Filed: Dec. 6, 2004

(65) Prior Publication Data

US 2005/0132882 A1 Jun. 23, 2005

(30) Foreign Application Priority Data

Dec. 17, 2003 (JP) ..... 2003-419229

(51) Int. Cl.
*B01D 53/02* (2006.01)
*C25B 1/24* (2006.01)
*C25B 15/02* (2006.01)

(52) U.S. Cl. ..... 96/135; 55/523; 204/278

(58) Field of Classification Search ..... 96/134, 96/135; 55/315, 523; 204/247, 255, 258, 204/266, 278
See application file for complete search history.

(56) References Cited

U.S. PATENT DOCUMENTS 2,879,212 A * 3/1959 Hill et al. ..... 205/411
3,796,025 A * 3/1974 Kasten ..... 96/136
3,870,616 A * 3/1975 Dempsey et al. ..... 204/228.5
4,294,683 A * 10/1981 Pere ..... 204/258
4,822,469 A * 4/1989 Shimomura et al. ..... 204/228.5
4,917,862 A * 4/1990 Kraw et al. ..... 422/4
5,690,797 A * 11/1997 Harada et al. ..... 204/228.5
6,059,859 A * 5/2000 Alvarez et al. ..... 95/117
6,080,293 A * 6/2000 Takeuchi et al. ..... 204/400
6,818,105 B2 11/2004 Tojo et al.

FOREIGN PATENT DOCUMENTS

CN 1354123 A 6/2002
CN 1441857 A 9/2003
EP 1 283 280 A1 2/2003
EP 1 367 149 A1 12/2003
JP 2001-295086 A 10/2001
JP 2002-339090 A 11/2002
JP 2003-190762 A 7/2003
JP 2004-353015 A 12/2004

* cited by examiner

*Primary Examiner*—Frank M Lawrence
(74) *Attorney, Agent, or Firm*—Oblon, Spivak, McClelland, Maier & Neustadt, P.C.

(57) ABSTRACT

A gas generator is provided in which the filter life is prolonged and the pressure regulating valve is thereby protected for a prolonged periods. The gas generator is intended for electrolyzing an electrolyte in an electrolytic cell to generate a gas or gases and comprises at least one absorber for absorbing an unnecessary by-products generated from the gas generator, a filter for removing the mist generated from the absorber, and at least one pressure regulating valve for adjusting the pressure in the electrolytic cell, wherein the filter is inserted downstream from the absorber and, further, the pressure regulating valve is disposed downstream from the filter.

4 Claims, 3 Drawing Sheets

GAS GENERATOR

FIELD OF THE INVENTION

This invention relates to a gas generator, in particular a gas generator capable to have longer service life of valves and filters to remove the mists in generated gases.

BACKGROUND OF THE INVENTION

For example, as shown in FIG. 2, a gas generator comprising an electrolytic cell, valves, filters, and absorbers to absorb unnecessary gas is known in the art.

The gas generator 200 shown in FIG. 2 comprises an electrolytic cell 1, an electrolyte 2, an anode chamber 3, a cathode chamber 4, a first liquid level sensor 5 for sensing the liquid level in the electrolyte 2 in the anode chamber 3, and a second liquid level sensor 6 for sensing the liquid level in the cathode chamber 4. It further comprises a pressure gauge 7 for measuring the pressure in the anode chamber 3, a pressure gauge 8 for measuring the pressure in the cathode chamber 4, and pressure regulating valves 9, 10 for adjusting the pressures in the anode and cathode chambers by opening or closing in conjunction with the pressures measured by the pressure gauges 7, 8; it further comprises a thermometer 11 for measuring the temperature in the electrolyte 2, an electrolyte warming heater 13 installed on the lateral and bottom of the electrolytic cell 1 and operated upon a signal from the thermometer 11. It further comprises an absorber 14 for absorbing unnecessary gases from the gas generated from the cathode chamber 4, and an absorber 15 packed with an agent for absorbing unnecessary gases generated from the anode chamber 3 to generate a required high-purity gas alone. It comprises an anode 51 and a cathode 52, and filters 53, 54 for removing mist generated together with gases upon electrolysis. (cf e.g. Patent Document: Japanese Patent Laid-open Application (JP-A) 2002-339090.)

In the gas generator shown in FIG. 2, however, the pressure regulating valves are installed before the absorber for absorbing unnecessary by-products generated from the electrolytic cell and, therefore, foreign matters containing solids generated together with gases will deposit in the pressure regulating valve inside, sometimes makes pressure adjustment impossible.

Accordingly, it is an object of the present invention to provide a gas generator having the filters and pressure regulating valves behind the respective absorber for absorbing unnecessary by-products generated together with gases so that such by-products may be absorbed before the passage of the exhaust gases through the filters and pressure regulating valves, wherein the service life of the filters are prolonged and the pressure regulating valves are protected for a prolonged periods.

SUMMARY OF THE INVENTION

The present inventors found that filter clogging is caused rather by sticking, to the filter, of liquid substances entrained by a solid matter than by a solid substance. In the case of gas generation using a fluoride electrolyte (KF·2HF molten salt), for instance, it was found that the cause of filter clogging in a short period of time is the sticking, to filter openings, of viscous substances containing HF in excess and entrained by solids rather than the blocking by the solids resulting from mists of KF·2HF. It has been understood that the gas space in the electrolytic cell containing the fluoride electrolyte is a space in which HF occurs in excess and it is the species KF·nHF (n=3, 4, 5, . . .), which are still lower in dissolution temperature than KF·2HF, rather than KF·2HF, that form the mist therein. This mist composed of these KF·nHF (n=3, 4, 5, . . .) presumably is the substance occurring in a liquid or viscous fluid state in spite of the temperature lowering in the relevant pipes. Based on such and other findings, the present inventors have now created a gas generator of the present invention. Thus, the invention provides a gas generator for electrolyzing an electrolyte in an electrolytic cell to generate a gas or gases which comprises at least one absorber for absorbing at least one unnecessary by-products generated from the gas generator, a filter for removing the mist discharged from the absorber, and at least one pressure regulating valve for adjusting the pressure in the electrolytic cell, wherein the filter is inserted downstream from the absorber and the pressure regulating valve is disposed downstream from the filter.

The above constitution makes it possible to absorb the unnecessary gas or gases at an early stage, so that the service life of the filter for removing the mist generated together with the desired gas or gases can be prolonged. As a result, the pressure regulating valve can be protected for a prolonged period of time.

The gas generator of the invention may contain a hydrogen fluoride-containing electrolyte.

Even the gas generator has such a constitution, the service life of the filter for removing the mist generated together with fluorine gas or hydrogen gas from the hydrogen fluoride-containing electrolyte can be prolonged.

In the gas generator of the invention, the absorber is preferably packed with a granular agent for absorbing the unnecessary gas or gases.

This constitution makes it possible to absorb the unnecessary gas or gases sufficiently, so that the service life of the filter can be prolonged and the pressure drop can be minimized.

The gas generator of the invention preferably shows a pressure drop of equal to or less than 0.05 MPa in the absorber.

Such constitution makes it possible to absorb the unnecessary gas or gases to a satisfactory extent in a reliable manner, so that the service life of the filter can be prolonged.

The inside of the elimination column of the gas generator of the invention is preferably heated to a temperature of not lower than 50° C.

This constitution makes it possible to absorb the unnecessary gas or gases to a satisfactory extent in a reliable manner, so that the service life of the filter can be further prolonged.

In the gas generator of the invention, the filter is preferably one having a porous structure or mesh structure constituted of a sintered metal or alloy.

This constitution makes it possible to remove the mist generated together with fluorine gas or hydrogen gas sufficiently, so that the pressure regulating valve can be protected for a prolonged period of time.

DETAILED DESCRIPTION OF THE INVENTION

Figure 2:
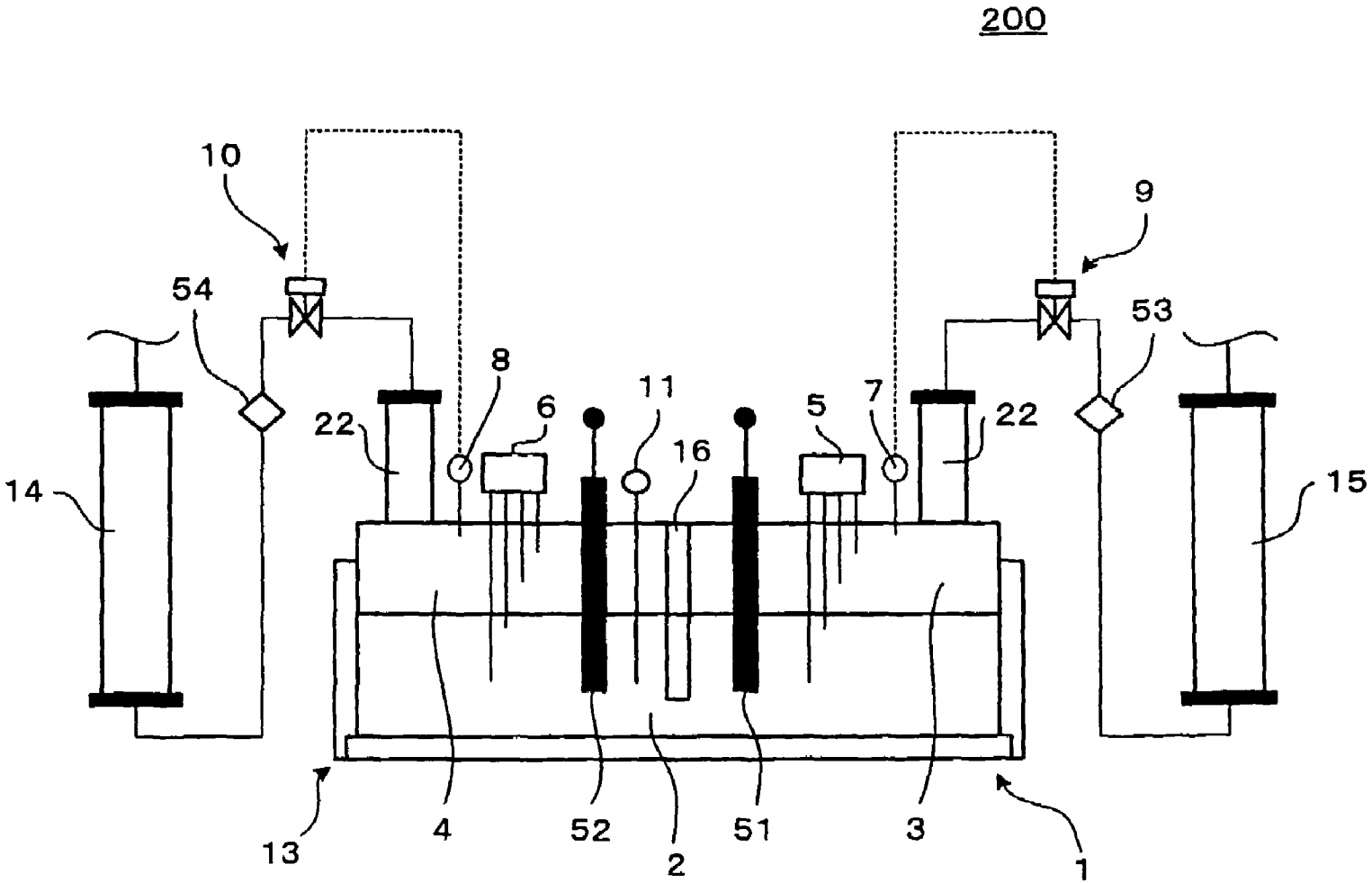
Fig. 2 PRIOR ART
FIG. 2 is a schematic representation of the main parts of a conventional gas generator.

An embodiment of the gas generator of the invention is now described referring to the accompanying drawings. Some of those parts or sites which have been described hereinabove referring to the conventional gas generator 200 shown in FIG. 2 will be not described again.

Figure 1:
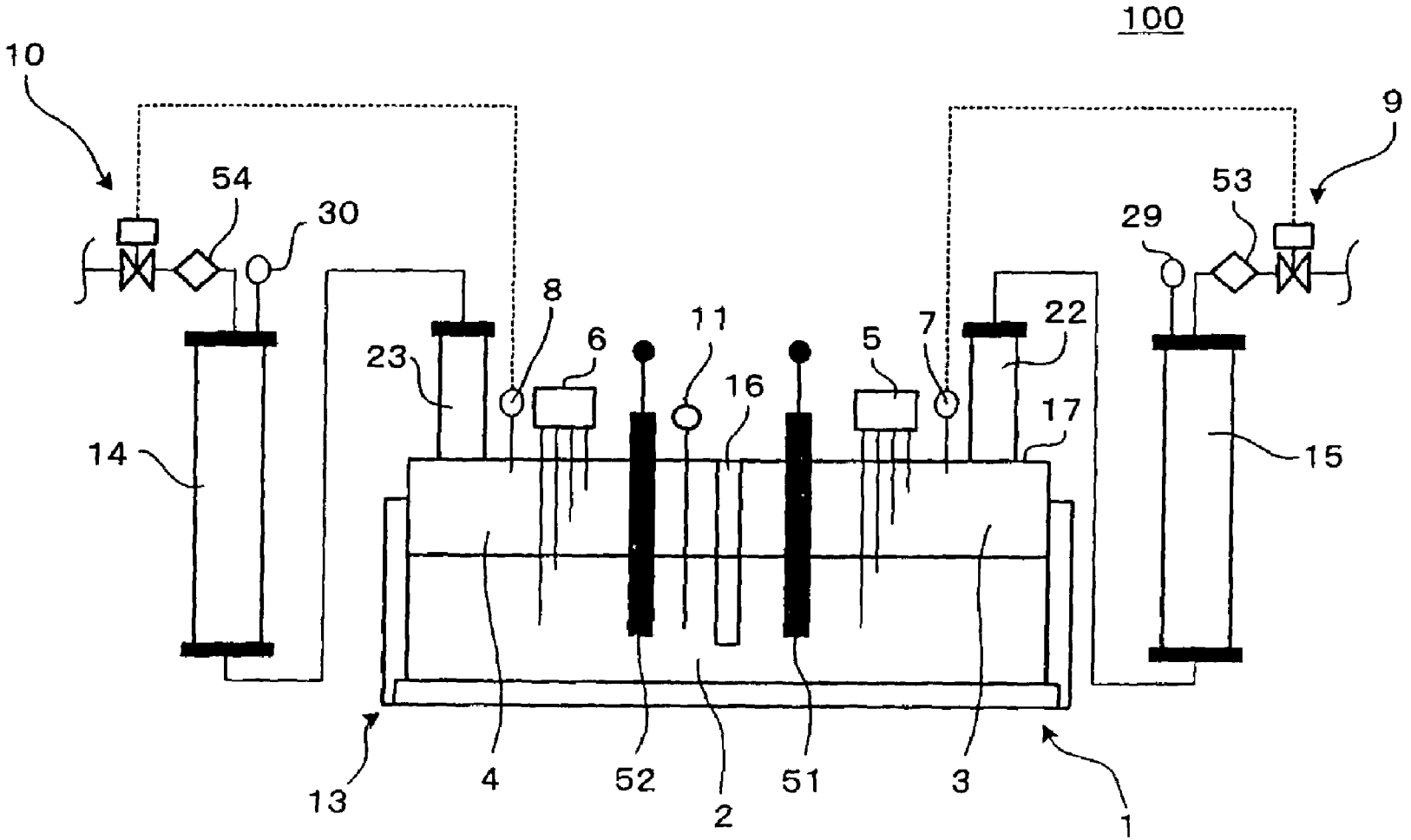
FIG. 1 is a schematic representation of the main parts of a gas generator of the invention.

FIG. 1 is a schematic representation of the main parts of a gas generator of the invention. The gas generator 100 shown in FIG. 1 has a constitution almost identical to that of the conventional gas generator 200 shown in FIG. 2. However, there is a great difference between them with respect to the order of disposition of the pressure regulating valves 9, 10, filters 53, 54 and absorbers 14, 15 in the generated gas passages. More specifically, the absorber, filter and pressure regulating valve in each line are disposed in that order from the electrolytic cell in the gas generator 100 shown in FIG. 1, whereas, in the gas generator 200 shown in FIG. 2, the pressure regulating valve, filter and absorber are disposed in that order in each line from the electrolytic cell.

The main constituent parts are described below one by one.

The electrolytic cell 1 is made of such a metal or alloy as nickel, Monel, iron or stainless steel. The electrolytic cell 1 is divided into an anode chamber 3 and a cathode chamber 4 by means of a partition wall 16 made of Monel. In the anode chamber 3, there is disposed an anode 51. In the cathode chamber 4, there is disposed a cathode 52. A low polarizable carbon electrode is preferably used as the anode 51, and nickel is preferably used as the cathode 52. The upper covering 17 of the electrolytic cell 1 is equipped with a gas discharge port 22 for the gas generated from the anode chamber 3 and a gas discharge port 23 for the gas generated from the cathode chamber 4. The upper covering 17 is also equipped with a hydrogen fluoride inlet (not shown) from a hydrogen fluoride feeding line (not shown) for feeding hydrogen fluoride upon a decrease in the liquid level of the electrolyte 2, a first liquid level sensor 5 and a second liquid level sensor 6 for detecting the liquid levels in the anode chamber 3 and cathode chamber 4, respectively, and pressure gauges 7, 8. The electrolytic cell 1 is equipped with a temperature adjusting means for heating the inside of the electrolytic cell 1.

In cases where the electrolytic bath 2 contains hydrogen fluoride, for instance, and hydrogen gas is to be generated by electrolysis, the absorber 14 for absorbing the unnecessary by-products generated from the cathode chamber 4 is preferably formed of a material resistant to corrosion by fluorine gas and hydrogen fluoride, for example stainless steel, Monel or nickel, and is preferably packed with sodium fluoride (hereinafter referred to as "NaF") or calcium carbonate (hereinafter, "$CaCO_3$") so that the unnecessary hydrogen fluoride passing therethrough, namely hydrogen fluoride in hydrogen gas, can be absorbed.

This absorber 14 is disposed on the upstream side of the filter 54, and the pressure regulating valve 10 is disposed on the downstream side of that filter 54.

In cases where the electrolyte 2 contains hydrogen fluoride, for instance, and fluorine gas is to be generated by electrolysis, the absorber 15 for eliminating the unnecessary by-products generated from the anode chamber 3, like the absorber 14 mentioned above, is preferably formed of a material resistant to corrosion by fluorine gas and hydrogen fluoride, for example stainless steel, Monel or nickel, and is preferably packed with NaF so that the hydrogen fluoride contained in the fluorine gas generated and discharged can be absorbed.

This absorber 15 is disposed on the upstream of the filter 53, and the pressure regulating valve 10 is disposed on the downstream of the filter 53.

These absorbers 14, 15 are equipped with pressure gauges 30, 29, respectively, so that possible clogging of the inside thereof can be detected. The pressure drop in each of the absorbers 14, 15 is desirably equal to or less than 0.05 MPa, preferably 0 to 0.01 kPa. This is because a small pressure drop facilitates the liquid level control. Desirably, the inside of each of the absorbers 14, 15 is heated to a temperature of 50° C. or higher, preferably 50° C. to 300° C., more preferably 90° C. to 150° C.

The filters 53, 54 preferably have a porous structure or mesh structure constituted of a sintered metal or alloy. As the material of the filters 53, 54, there may be mentioned stainless steel, nickel, Monel and Hastelloy.

In accordance with this mode of embodiment, the unnecessary gas absorbance can be accomplished at an earlier stage to a satisfactory extent and in a reliable manner and, therefore, the service life of the filters for removing the mist generated together with the desired gas can be prolonged. As a result, the pressure regulating valves can be protected for a prolonged periods.

Since the filters have a porous structure or mesh structure constituted of a sintered metal or alloy, the unnecessary by-products generated simultaneously with fluorine gas and/or hydrogen gas can be absorbed sufficiently, so that the pressure regulating valves can be protected for a prolonged periods.

In a gas generator for electrolyzing an electrolyte containing hydrogen fluoride, which may be mentioned as a specific example of the gas generator, the service life of the filters for absorbing the unnecessary by-products generated together with fluorine gas and/or hydrogen gas can be surely prolonged.

The following examples further illustrate the present invention. In the following working examples and comparative examples, fluorine was generated in the respective gas generators for verification of the effects of the invention.

EXAMPLE 1

NaF was used as the agent for absorbing hydrogen fluoride in the absorber of a gas generator according to the invention. NaF was pelletized and the absorbers were packed therewith so as to allow gas passage. The NaF pellets were cylindrical, 3 mm in diameter and 3 mm in length. The NaF packed bed in each absorber was 100 mm in diameter (column inside diameter) and 500 mm in length. The pressure drop was adjusted to 0.01 MPa.

The thus-prepared absorbers were disposed downstream from the electrolytic cell, a filter (¼ inch filter) for pressure regulating valve protection was disposed downstream from each absorber, and a pressure regulating valve for adjusting the pressure in the electrolytic cell was disposed further downstream from each filter to construct a gas generator.

EXAMPLE 2

The absorber on the fluorine gas generation side was packed with the same NaF as used in Example 1. On the occasion of operation, the absorber inside was heated to 100° C. The absorber on the hydrogen generation side was packed with $CaCO_3$ as the agent for absorbing hydrogen fluoride. The $CaCO_3$-packed bed in the absorber was 200 mm in diameter (column inside diameter) and 1,000 mm in length. The pressure drop was adjusted to 0.01 MPa.

The thus-prepared absorbers were disposed downstream from the fluorine gas line and hydrogen gas line, respectively, and a sintered metal-made filter (¼ inch filter) was disposed downstream from each of these absorbers, and pressure regulating valves for adjusting the pressure in the electrolytic cell were disposed further downstream to construct a gas generator.

COMPARATIVE EXAMPLE 1

Figure 3:
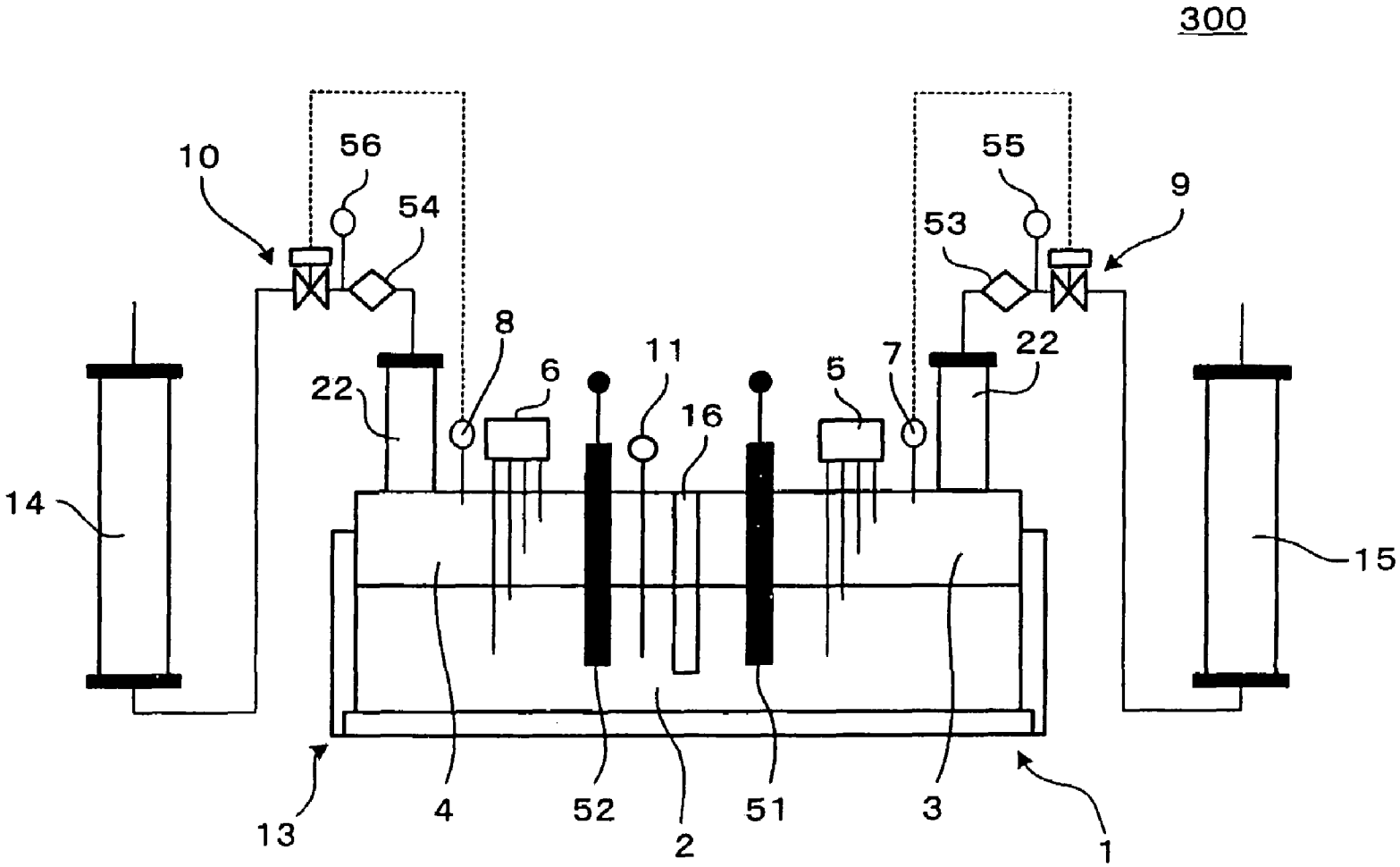
Fig.3 PRIOR ART
FIG. 3 is a schematic representation of those main parts of a gas generator disclosed in a patent specification filed previously by the present applicants which are comparable with those of a gas generator of the present invention.

The present applicants have already filed, in Japan, a patent application as of Nov. 8, 2002 under the application number 2002-324759. (They have also filed a patent application (application number 2003-379328) in Japan as of Nov. 10, 2003, claiming priority based on the above application 2002-324759.) Those parts of the gas generator disclosed in the senior application 2002-324759 and comparable with those disclosed herein are schematically shown in FIG. 3. In the gas generator 300 shown in FIG. 3, the order of disposition of the pressure regulating valve 9 and filter 53 and the order of disposition of the pressure regulating valve 10 and filter 54 are reversed as compared with those in the gas generator shown in FIG. 2 and, further, pressure gauges 55, 56 for detecting clogging of the pressure regulating valves by unnecessary components or the like are disposed between each pressure regulating valve and each filter.

In a gas generator having the same constitution as the gas generator shown in FIG. 3, in-line filters (26 mm in diameter, 40 mm in length) were disposed in ⅜ inch pipe lines serving as flow passages for the gases generated and so on to construct a fluorine generator 100A, as shown in FIG. 3.

COMPARATIVE EXAMPLE 2

A fluorine generator of Comparative Example 2 was constructed by substituting large-sized filters, 60 mm in diameter and 250 mm in length (filter surface area: 460 $cm^2$), for the in-line filters in the fluorine generator of Comparative Example 1.

COMPARATIVE EXAMPLE 3

A fluorine generator of Comparative Example 3 was constructed by substituting leaf-type filters, 70 mm in diameter and 110 mm in length (filter surface area: 425 $cm^2$), for the in-line filters in the fluorine generator of Comparative Example 1.

In Example 1, pipes for use downstream from the electrolytic cell of the gas generator were manufactured and disposed in the fluorine gas line and hydrogen gas line, respectively, the inside of each absorber was heated to 100° C. by winding a ribbon heater around the column, the gas generator was operated, and the filter life was checked.

In Example 2 and Comparative Examples 1 to 3, each gas generator was operated as such and the filter life was checked. The cumulative electric energies consumed in operating the respective electrolyzers without filter clogging by foreign matter are shown below in Table 1 as the filter life.

TABLE 1

| | Cumulative electric energy (Ahr) |
|---|---|
| Example 1 | 216000 |
| Example 2 | 108000 |
| Comparative Example 1 | 2000 |
| Comparative Example 2 | 8000 |
| Comparative Example 3 | 5000 |

As shown in Table 1, it could be confirmed that the cumulative electric energy values were overwhelmingly greater in Examples 1 and 2 according to the invention than in Comparative Examples 1 to 3. Thus, it could be confirmed that the gas generators of the invention can prolong the filter lives as compared with the conventional gas generators and the electrolyzer operation can be continued for a prolonged period of time.

The cumulative electric energy values were low in the gas generators of Comparative Examples 1 to 3 because the filters and pressure regulating valves were disposed in front of the respective absorbers for absorbing unnecessary by-products generated from the electrolytic cell, so that a solid matter-containing foreign matter generated together with the gases deposited on the filters and rendered pressure adjustment impossible.

Various design changes and modifications of the invention can be made without departing from the scope of the claim for patent, and the mode of embodiments and examples described above are by no means limitative of the scope of the invention.

What is claimed is:

1. A gas generator for electrolyzing an electrolyte in an electrolytic cell to generate a gas or gases, which comprises:

an electrolytic cell;

at least one absorber communicating with the electrolytic cell and packed with pellets of an agent capable of eliminating at least one unnecessary by-product generated by the electrolytic cell while allowing a gas generated by the electrolytic cell to pass between the pellets, whereby the at least one unnecessary by-product generated by the electrolytic cell may be absorbed by the least one absorber, a filter disposed downstream from said at least one absorber and capable of removing a mist discharged from the absorber;

at least one pressure regulating valve disposed downstream from said filter for adjusting the pressure in the electrolytic cell;

a liquid level sensor for sensing the liquid level in the electrolyte; and a pipe which communicates the electrolytic bath with the pressure regulating valve, wherein the pipe forms a closed space without branching, wherein the pressure drop in the at least one absorber is equal to or less than 0.05 MPa.

2. A gas generator according to claim 1, wherein the electrolyte contains hydrogen fluoride.

3. A gas generator according to claim 1, wherein the absorber inside is heated to a temperature of not lower than 50° C.

4. A gas generator according to claim 1, wherein the filter has a porous structure or mesh structure constituted of a sintered metal or alloy.

* * * * *